United States Patent [19]

Langford

[11] 4,295,636

[45] Oct. 20, 1981

[54] SYSTEM FOR INHAULING AND OUTHAULING LINES

[75] Inventor: Frederic E. Langford, Redmond, Wash.

[73] Assignee: Washington Logging Equipment, Inc., Auburn, Wash.

[21] Appl. No.: 961,224

[22] Filed: Nov. 16, 1978

[51] Int. Cl.[3] ..... B66D 1/26

[52] U.S. Cl. ..... 254/304; 212/76

[58] Field of Search ..... 254/304, 305, 298, 299, 254/300, 301, 302, 303, 309, 310; 212/76, 77

[56] References Cited

U.S. PATENT DOCUMENTS

| | | | |
|---|---|---|---|
| Re. 18,220 | 10/1931 | McGiffert | 254/305 X |
| Re. 26,505 | 12/1968 | Thompson | 254/185 AB |
| 1,248,600 | 12/1917 | Bathrick . | |
| 1,389,324 | 8/1921 | Stevenson | 254/305 |
| 1,559,692 | 11/1925 | Gorbutt . | |
| 1,578,709 | 3/1926 | Bjorge | 254/304 |
| 1,826,303 | 10/1931 | Dickinson . | |
| 3,282,569 | 11/1966 | Thompson | 254/184 |
| 3,912,229 | 10/1975 | Mitchell | 254/185 AB |

*Primary Examiner*—John M. Jillions
*Attorney, Agent, or Firm*—Christensen, O'Connor, Johnson & Kindness

[57] ABSTRACT

A cable hauling system includes a drive shaft, a haulback shaft with a haulback drum mounted thereon, and a main shaft with a main drum mounted thereon. A first pair of gears operatively associated with the drive shaft and the main shaft includes a positively acting clutch for selectively coupling the drive shaft to the main shaft in driving relationship through the first pair of gears. Second and third pairs of gears are operatively associated with the drive shaft and the haulback shaft. An energy-dissipating, power transfer device is associated with both the second and third pairs of gears to selectively couple one or the other of the second and third pairs of gears in driving relationship with the haulback shaft. The gear ratios of the second and third pairs of gears are chosen and the power transfer device is operable to allow relative restrained movement between the drive shaft and the haulback shaft so that the line speed to and from the haulback drum can be equalized with the line speed from and to the main drum.

2 Claims, 4 Drawing Figures

SYSTEM FOR INHAULING AND OUTHAULING LINES

BACKGROUND OF THE INVENTION

This invention relates to a cable hauling system and, more particularly, to a mechanical cable hauling system employing only an energy-dissipating, power transfer device to allow differential rotation between a haulback drum and a main drum.

In cable hauling systems normally used for yarding logs, cable is wound about a haulback drum. From the haulback drum, the cable threaded through an idler sheave on a boom and extends outwardly to an outhaul block at a location remote from the boom. The portion of the cable extending from the haulback drum to the outhaul block is referred to as the haulback line. The cable then extends from the outhaul block back toward the boom to a grapple carriage, a choker cable, or other mechanism for grasping and holding a log or turn of logs. From the carriage, the cable extends back to the boom, through another idler sheave and is wound about a second drum, normally referred to as a main drum. The portion of the cable extending from the outhaul block to the main drum is referred to as the main line.

In coventional cable hauling systems, positively acting clutches are employed to selectively engage either the main drum or the haulback drum to a drive shaft, depending upon whether the carriage is to be brought toward or away from the boom. When a clutch associated with one of the drums is engaged, the clutch associated with the other drum, generally referred to as the trailing drum, is disengaged. Large, energy-dissipating brakes are associated with the trailing drum to prevent it from free wheeling and thus to maintain tension in the cables. Such mechanical braking is satisfactory for intermediate sized systems and for some larger systems. For larger, high horsepower systems, however, brake wear is excessive, resulting in constant maintenance and replacement of brake linings. Moreover, for such systems, control over the speed of the haulback line and the main line during hauling and lowering and raising of the turn of logs can be imprecise, consequently requiring that an operator possess much experience to handle the system well and efficiently.

Another cable hauling system currently used is generally referred to as an interlocked system. In an interlocked system, the main drum and the haulback drum are usually driven from a common drive shaft and are either counterrotated or the cables are wound in opposite directions thereon to haul the carriage from the outhaul block to the boom and back again. During hauling of the carriage, the effective diameters of the main drum and haulback drum vary because the number of wraps of cable on each of the drums vary as line is wound onto and payed out from the drums. Assuming the two drums are driven at constant speeds, the varying effective diameters of the main drum and the haulback drum will cause a slackening or tightening of the main line and haulback line as the carriage is being hauled. The slackening or tightening of the main and haulback lines is compensated for in most interlocked systems by either a mechanical or hydraulic variable speed differential.

Both the mechanical and hydraulic interlocked systems are relatively expensive. Thus, they are uneconomical to employ in applications where only small cable hauling systems are required. Likewise, the use of two or more energy-dissipating, slipping brakes in the conventional systems is economically prohibitive because of the associated large initial costs and ongoing maintenance costs. Thus, none of the prior art systems is really suitable for the smaller logging operations where only one or a few logs are hauled at one time. Accordingly, it is a broad object of the present invention to provide a relatively inexpensive, relatively low maintenance, simple to operate cable hauling system, especially such a cable hauling system for use in yarding logs or transferring other loads from one point to another along a generally fixed path. Further objects of the present invention are to provide a relatively simple mechanical system that employs an energy-dissipating, power transfer device, but at the same time reduces wear and maintenance on the clutch parts; and to provide such a system in which the power transfer device functions to provide variable speed interlock between a main drum and haulback drum regardless of the rotational direction.

SUMMARY OF THE INVENTION

In accordance with the foregoing objects and other objects that will become apparent to one of ordinary skill upon reading the following specification, the present invention provides an improvement in a system for inhauling and outhauling line including a drive shaft, a haulback drum mounted on a haulback shaft and a main drum mounted on a main shaft. A prime mover is operably coupled to rotatably drive the drive shaft. A reversible transmission is interposed between the prime mover and the drive shaft so that the rotational direction of the drive shaft can be selectively reversed. The improvement comprises first, second and third gear means operably associated with the drive shaft, haulback shaft and main shaft to drive the haulback and main shafts from the drive shaft, and an energy-dissipating, power transfer device for allowing relative rotational movement between the drive shaft and one or the other of the haulback shaft and the main shaft, that is, to allow differential rotation between the haulback shaft and the main shaft to compensate for the different number of turns of cable on the haulback and main drums during inhaul and outhaul.

The first gear means operably couples the drive shaft to one of the main and haulback shafts in driving engagement to rotate the corresponding drum on the one shaft to take in and pay out line at a first line speed. The second gear means selectively couples the drive shaft to the other of the main and haulback shafts in driving engagement to rotate the corresponding drum on the other shaft to take in and pay out line at a line speed less than the first line speed. The third gear means selectively couples the drive shaft to the other shaft in driving engagement to rotate the corresponding drum on the other shaft to take in and pay out line at an effective line speed greater than the first line speed. An energy-dissipating, power transfer device is associated with both the second and third gear means for allowing restrained, relative, rotational movement between the drive shaft and the other shaft so that the line speed to and from the haulback drum can be substantially equalized with the line speed respectively from and to the main drum.

BRIEF DESCRIPTION OF THE DRAWINGS

A better understanding of the present invention can be derived by reference to the ensuing specification in conjunction with the accompanying drawings, wherein.

DETAILED DESCRIPTION OF THE INVENTION

Figure 1:
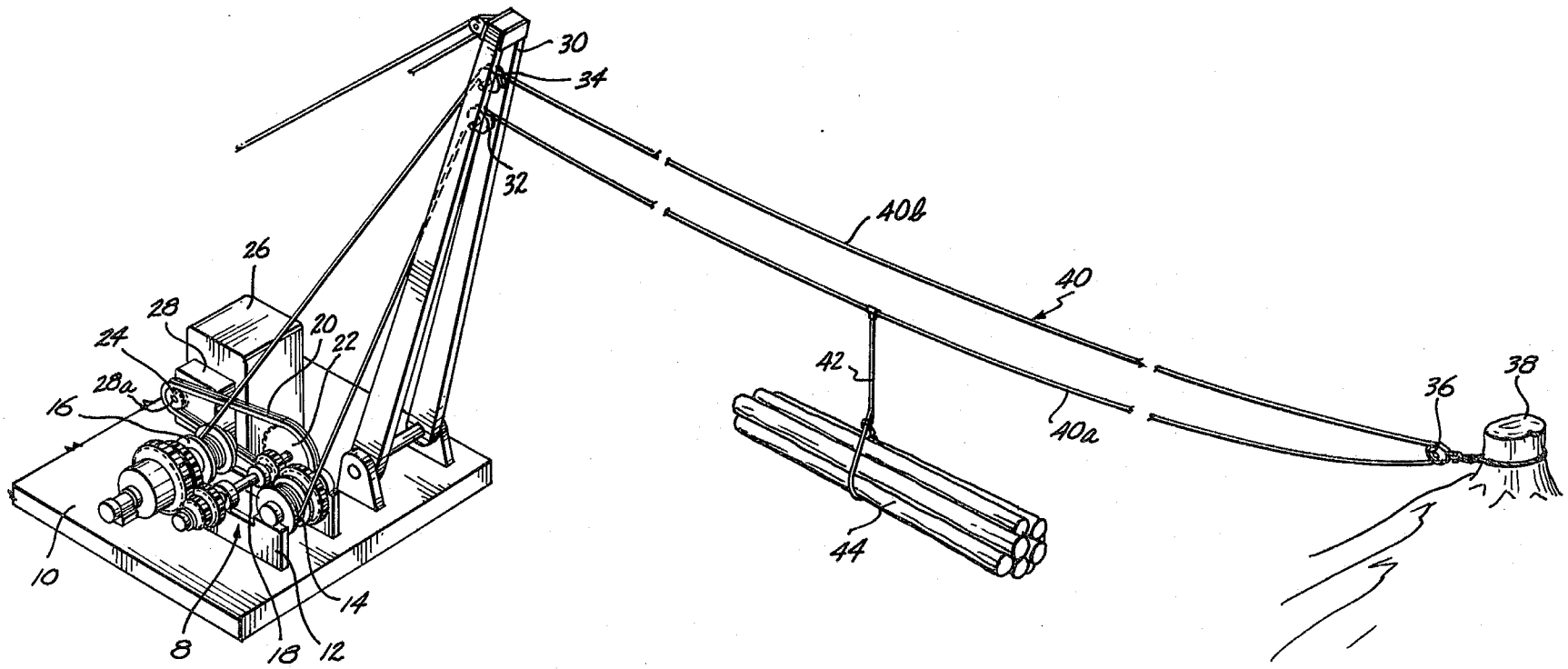
FIG. 1 is an isometric view of a system for inhauling and outhauling lines, particularly as applied to the yarding of logs, employing the improved drive system of the present invention.

Referring to FIG. 1, a cable hauling system especially adapted for use in yarding logs is illustrated. In this yarding system, a platform 10 supports a cable hauling drive system, generally designated 8, which includes a main drum 14, a haulback drum 16, a drive shaft 18 and associated shafts, gearing and clutches that will be described in greater detail below, all of which are mounted on a suitable frame 12. The drive shaft 18 is driven via an endless chain 20 engaging a driven gear 22 fixed to the drive shaft 18 and a drive gear 24 mounted on a transmission output shaft 28*a*. The drive gear 24 is rotated via a conventional prime mover 26 through a suitable transmission 28. The prime mover can be a diesel engine or other suitable source of motive power. The transmission 28 is a conventional, multiple speed, reversible transmission driven from the output shaft (not shown) of the prime mover. The rotational direction of the output shaft 28*a* of the transmission 28 can be reversed at will either remotely or manually.

A boom 30 is mounted on the platform 10 adjacent the drive system 8. The boom carries a pair of idler sheaves 32 and 34 at its upper end. At a location remote from the boom 30, an outhaul block or sheave 36 is securely anchored to the ground, for example to a tree stump 38. Several turns of one end of a line or cable (the terms line and cable are used interchangeable herein), generally designated 40, are wound onto the main drum 14. From the main drum 14, the cable extends upwardly to the lower sheave 32 on the boom and thence outwardly to the outhaul block 36. The line is wrapped about the outhaul block 36, extends back toward the boom, is then draped over the upper sheave 34 on the boom, and extends downwardly to the haulback drum 16 where several turns of the other end of the line 40 are wrapped about the haulback drum. The portion of the cable 40 extending between the main drum 14 and the outhaul block 36 will hereinafter be referred to as the main line 40A while the portion of the cable 40 extending from the outhaul block 36 to the haulback drum 16 will hereinafter be referred to as the haulback line 40B. A choker cable 42 or other suitable log grasping apparatus is suspended from the main line 40A. As shown in FIG. 1, the choker cable is wrapped about a plurality of logs, commonly referred to as a turn of logs 44.

In operation, a turn of logs is suspended from the choker cable 42 at a location adjacent the outhaul block 36. The improved drive system for the main drum and haulback drum is operated so that the cable is wound onto the main drum and cable is payed out by the haulback drum, thus causing the choker cable and consequently the turn of logs 44 to be transported from adjacent the outhaul block 36 to adjacent the yarding platform 10. At that location, the turn of logs is released from the choker cable and the operation of the improved drive assembly for the main drum and haulback drum is reversed so that cable is payed out by the main drum while cable is wound onto the haulback drum, thus returning the choker cable to its location adjacent the outhaul block to be attached to another turn of logs for transport into the platform 10.

As explained in the background of the invention, as line is being payed out and wrapped onto the main and haulback drums, the effective diameters of the drums change. As the effective diameter of the drums change, the relative speed with which line is payed out and wrapped onto the drums changes if the drums are driven at constant speeds. The improved drive system 8 of the present invention provides for differential rotation of the drums in a relatively inexpensive, simple manner to maintain the main line 40A and haulback line 40B taut at all times. In addition, the improved drive assembly of the present invention will easily allow slack to be let into the main line, for example, so that a turn of logs suspended from the choker cable 42 can be raised from the ground when adjacent the outhaul block and lowered to the ground when adjacent the platform.

Figure 2:
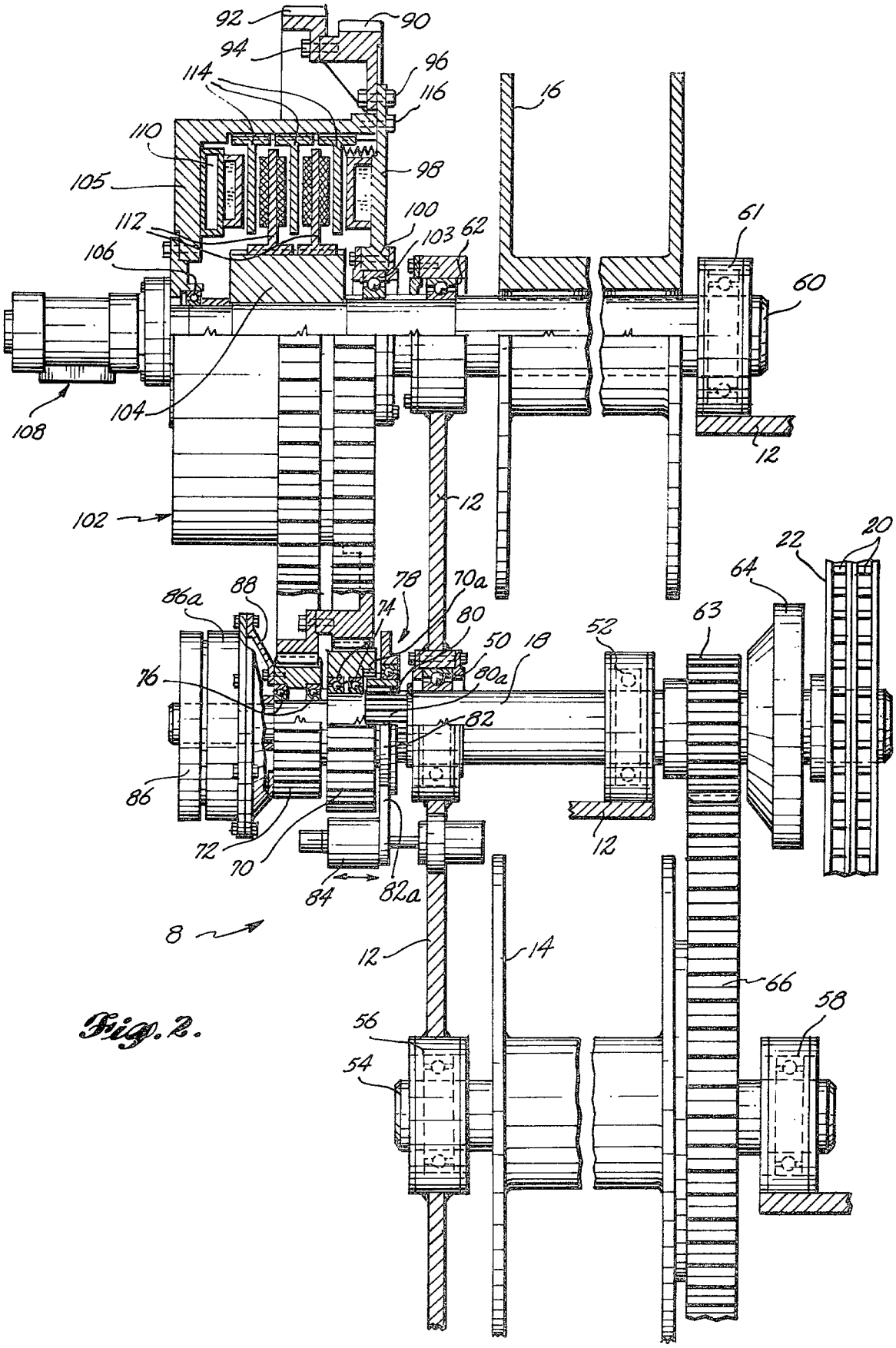
FIG. 2 is a detailed plan view, in partial cross section, of a first embodiment of the present invention.

Referring to the detailed drawing of FIG. 2, the drive shaft 18 is journalled on the frame 12 by bearings 50 and 52. A main shaft 54 is also journalled on the frame 12 by bearings 56 ad 58. Likewise, a haulback shaft 60 is journalled on the frame 12 by bearings 61 and 62. The driven gear 22 is splined or keyed to the drive shaft 18 and is driven by the chain 20. A first spur gear 63 is journalled on the drive shaft 18 for rotation relative to the drive shaft by a conventional bearing (not shown). A conventional positively acting, plate-type clutch 64 can be selectively actuated to couple the spur gear 63 to the drive shaft 18 for rotation therewith or to disengage the spur gear 63 from the drive shaft so that it can rotate relative to the drive shaft 18. The spur gear 63 meshes with a larger spur gear 66 that is splined, keyed or otherwise affixed to the main shaft 54 adjacent the main drum 14. When the clutch 64 couples the spur gear 63 for rotation with the drive shaft 18, the larger spur gear 66 drives the main shaft 54 and thus the main drum in a direction opposite the direction of rotation from the drive shaft 18. Alternatively, if desired, a plate-type clutch similar to clutch 64 can be mounted on the main shaft 54 to selectively engage and disengage the larger spur gear 66 from the main shaft 54 to eliminate the need for clutch 64 on the drive shaft 18.

Spur gears 70 and 72 are both mounted for rotation on the drive shaft 18 by bearings 74 and 76, respectively. Spur gear 72 has a smaller diameter than does spur gear 70. The spur gear 70 can be selectively coupled to the drive shaft 18 for rotation therewith by a jaw clutch, generally designated 78. The jaw clutch 78 has an internal ring 80 with internal splines that engage mating external splines 80*a* on the drive shaft 18. The ring 80 has external splines on its one end that can mate with internal splines 70*a* formed on an annular shoulder in a recess on the side of the spur gear 70 facing the jaw clutch 78. When the ring 80 is moved in the direction of the spur gear 70, the external splines on the ring 80 mate with the internal splines 70*a* on the spur gear 70 to engage the spur gear 70 for rotation and driven engagement by the drive shaft 18. When the ring 80 is moved in a direction away from the spur gear 70, the ring 80 moves out of engagement with the splines 70*a* in the spur gear 70 and thus disengages the external splines on the ring 80 from the internal splines 70*a* in the spur gear 70. Thus, when the jaw clutch 78 is in its disengaged mode, the spur gear 70 is allowed to rotate freely relative to the drive shaft 18. The ring 80 of the jaw clutch is coupled to an actuator ring 82 via a thrust bearing. The actuator ring 82 has a radially extending arm 82*a* which in turn is coupled to a hydraulic or pneumatic reciprocable actuator 84 affixed to the frame 12. The actuator 84 is of conventional design and, upon actuation from a remote location, will reciprocate the jaw clutch 78 into and out of engagement with the spur gear 70, thus selectively coupling the spur gear 70 to the drive shaft 18.

A conventional, positively acting plate-type clutch 86 is also mounted on the end of the drive shaft 18 opposite from that on which the driven gear 22 is mounted. The plate-type clutch 86 is of conventional design and selectively couples the spur gear 72 for rotation with and driving engagement by the drive shaft 18. The central portion of the plate-type clutch 86 is coupled to the drive 18 shaft while the outer portion 86A of the clutch is coupled via flange 88 to the spur gear 72. Thus, when the clutch 86 is engaged, the spur gear 72 rotates with the drive shaft 18. When the clutch 86 is disengaged, the spur gear 72 as well as the outer housing 86A of the clutch are free to rotate relative to the drive shaft 18.

Both of the plate-type clutches 64 and 86 are of conventional design and are commercially available from a variety of sources. For example, a plate-type clutch suitable for use with the present invention is that commercially available from Twin Disc Incorporated, having a district office in Bellevue, Wash., and sold under the product name Twin Disc PO Air Clutch.

Each of the spur gears 70 and 72 mesh respectively with a corresponding set of spur gears 90 and 92 mounted for rotation on and about the haulback shaft 60. The spur gears 90 and 92 both have effective diameters substantially larger than the spur gears 70 and 72, while the effective diameter of gear 92 is slightly larger than that of gear 90. Both gears 90 and 92 are formed as ring gears. Gear 92 is suitably affixed by fasteners 94 to gear 90. Gear 90 is in turn affixed by suitable fasteners 96 to a circular gear plate 98. The central portion of gear plate 98 is affixed to a hub 100, in turn mounted on a bearing 103 that journals the gear plate 98, and thus the gears 90 and 92, for rotation relative to the haulback shaft 60.

A large, air operated, water cooled, energy absorbing, slipping clutch 102 is also mounted on the haulback shaft 60 adjacent the spur gears 90 and 92. The central driving member 104 of the slipping clutch is splined, keyed or otherwise affixed to the haulback shaft 60 for rotation therewith. The outer shell 105 of the slipping clutch is journalled via bearing 106 on the haulback shaft 60. Pressurized air and cooling water are fed to the clutch via a rotating coupling, generally designated 108. The outer shell 105 of the clutch carries an air diaphragm 110, which when expanded with pressurized air moves a plurality of driving clutch plates 112 affixed to the driving member 104 into driving engagement with a plurality of driven clutch plates 114 operably affixed in a conventional manner to the outer shell 105. Thus, when the diaphragm 110 is expanded, the outer shell 105 is coupled to the driving member 104. The outer shell 105 of the clutch is in turn affixed by suitable fasteners 116 to the gear plate 98. Thus, when the air diaphragm is expanded and the clutch plates 112 and 114 are interengaged, the spur gears 90 ad 92 are coupled to the haulback shaft 60 via the slipping clutch 102. When the air pressure is completely relieved from the diaphragm 110, the clutch plates 112 and 114 are disengaged, thus allowing the spur gears 90 and 92 to rotate about but independently from the haulback shaft 60. By varying the amount of air pressure supplied to the diaphragm 110, the frictional engaging force between the clutch plates 112 and 114 can be varied. By so vary the frictional engaging force, the haulvack shaft 60 can be driven at a differential rotational speed relative to the driven spur gears 90 and 92. The heat energy generated by the relative motion between the clutch plates 112 and 114 is transferred to cooling water supplied to the slipping clutch 102 via the coupling 108, thus preventing any substantial buildup of heat and dissipating the heat energy produced by the relative motion of the clutch plates. A suitable energy absorbing, slipping clutch of the type described is commercially available from Eaton Corporation, Industrial Drives Division, Seattle District Office, Seattle Wash.

Referring to FIGS. 1 and 2 conjunctively, the purpose and operation of the improved drive system for hauling cables will be explained. When, for example, a turn of logs is adjacent the yarding platform, the main drum has a substantial number of wraps of cable on it while the haulback drum has only a few wraps of cable. Thus the effective diameter of the main drum is substantially greater than the effective diameter of the haulback drum. When it is desired to return the choker to a location adjacent the outhaul block 36, the plate clutch 64 is actuated to couple the spur gear 63 to the drive shaft 18, thus driving the main drum to unwind cable therefrom upon rotation of the drive shaft in a first direction. At the same time, the larger spur gear 70 is engaged to the drive shaft 18 by the jaw clutch 78. Simultaneously, the smaller spur gear 72 is disengaged by disengaging the air operated clutch 86. Thus, the spur gear 90 on the haulback shaft is engaged to the drive shaft 18 in driving relationship, while the spur gears 92 and 72 are disengaged from the drive shaft 18. The diameters of the spur gears 70 and 90 are chosen such that during outhaul the speed with which line is taken up by the haulback drum will be slightly greater than the speed with which line is payed out by the main drum. As the cable builds up on the haulback drum and as cable is payed out from the main drum, the effective diameters of the drums will change. To prevent undue tightening of the haulback and main lines 40B and 40A as the effective diameters of the drums change, the air pressure to the diaphragm 110 of the slipping clutch 102 is reduced slightly to allow slippage, that is, relative motion, between the spur gear 90 and the haulback shaft 60 to substantially equalize the speed of the takeup of the haulback line on the haulback drum and the speed at which line is being payed out from the main drum. As the line builds up on the haulback drum, more slippage must be allowed between the spur gear 90 and the haulback shaft 60 to maintain the equalized line speed.

To return the choker cable 42 with a turn of logs 44 toward the platform 10, the jaw clutch 78 is disengaged from the spur gear 70 while the air operated clutch 86 couples the spur gear 72 to the drive shaft 18. In this manner, the spur gears 72 and 92 are coupled in driven relationship with the drive shaft 18 while the spur gears 70 and 90 are disengaged from the drive shaft and allowed to rotate freely relative to the drive shaft. The plate-type clutch 64 remains engaged so that gear 63 is maintained in driven relationship by the drive shaft 18. The direction of rotation of the output shaft 28*a* of the transmission is then reversed so that line will be taken up by the main drum upon rotation of the drive shaft and line payed out by the haulback drum. At this juncture, the number of wraps of line on the main drum is normally less than the number of wraps on the haulback drum, thus usually leaving the effective diameter of the main drum less than that of the haulback drum. The diameters of the spur gears 72 and 92 are chosen such that, under these circumstances, the speed of the line payed out from the haulback drum will always be slower than the speed of the line taken up by the main drum so as to pay out line from the haulback drum at a rate slightly less than that at which the main drum takes up line. Once any slack is taken out of the main line and haulback line, some relative slippage must be allowed between the clutch plates 110 and 112 in the slipping clutch 102. As the number of turns of line builds up on the main drum, it will take up line faster as line is being payed out by the haulback drum. When this occurs, additional relative slippage or motion must be allowed to occur between the spur gear 92 and the haulback shaft 60. Again, the relative rotation is accomplished by selectively and gradually reducing the engagement force on the clutch plates 110 and 112 in the slipping clutch. Again, the heat produced by the slipping clutch plates is absorbed by the coolant being circulated through the slipping clutch.

Figure 3:
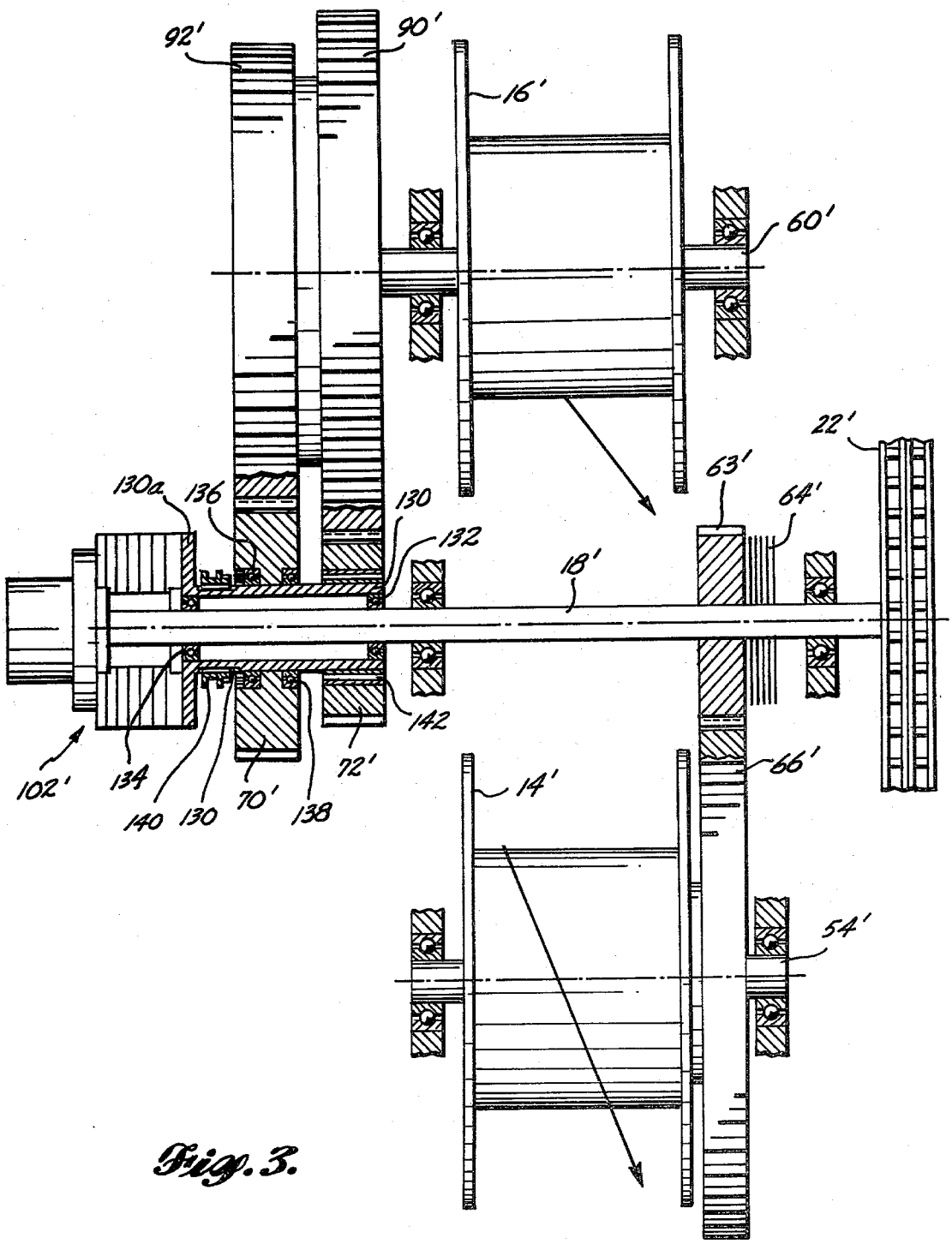
FIG. 3 is a partially schematic plan view, in partial cross section, illustrating a second embodiment of the present invention.

An alternate embodiment of the present invention schematically illustrated in FIG. 3 is similar in construction to the embodiment described in conjunction with FIG. 2 but differs in the arrangement of the spur gears driving the haulback drum and in location of the slipping clutch. In the alternate embodiment, the driven gear 22′ is mounted on the drive shaft 18′ in driving relationship therewith. A spur gear 63′ is selectively couplable to the drive shaft 18′ by a conventional plate-type clutch 64′. Spur gear 63′ meshes with the main drum spur gear 66′, in turn affixed to the main shaft 54′ to drive the main drum 14′. Similarly, the haulback drum 16′ is mounted on the haulback shaft 60′ in driving relationship therewith. In this embodiment, however, the spur gears 90′ and 92′ driving the haulback shaft 60′ are mounted directly on and splined, keyed or otherwise affixed to the haulback shaft 60′. In this embodiment, relative rotational movement can occur between spur gears 70′ and 72′ and the drive shaft 18′. As in the previous embodiment, the spur gears 70′ and 72′ are mounted for rotation relative to the drive shaft 18′. Instead of being directly mounted on the drive shaft, however, in this embodiment the spur gears are mounted on a sleeve 130 which in turn is mounted by suitable bearings 132 and 134 for rotation about and relative to the drive shaft. A radially outwardly extending plate 130*a* is affixed to one end of the sleeve 130 adjacent the corresponding end of the drive shaft 18′ on which the sleeve is mounted. The slipping clutch 102′ has its driving portion affixed directly to the end of the drive shaft 18′, while the driven portion of the slipping clutch is affixed by a suitable means to the plate 130*a* on the sleeve 130. The larger of the two spur gears 70′ and 72′ is in turn mounted for rotation on and relative to the sleeve 130 via bearings 136 and 138. A jaw clutch 140, constructed similarly to the jaw clutch 78 described in conjunction with the previous embodiment, but shown schematically in FIG. 3, selectively couples the larger spur gear 70′ for driving engagement to the sleeve 130. The smaller gear 72′ of the two spur gears is also mounted for rotation on the sleeve 130 via bearings (not shown) incorporated in a conventional sprag clutch 142. The sprag clutch is operable to couple the spur gear 72′ to the sleeve 130 as the sleeve 130 and drive shaft 18′ rotate in a first direction. However, when the sleeve 130 and drive shaft 18′ are rotated in the opposite direction, or if the spur gear 72′ is rotated faster than the sleeve 130, the sprag clutch will allow the spur gear 72′ to disengage from the sleeve 130.

Thus, during outhaul, that is, when line is being wrapped onto the haulback drum, the jaw clutch 140 is engaged, thus coupling the spur gear 70′ to the sleeve 130. The diameters of the spur gears 70′ and 92′ are chosen such that the line speed onto the haulback drum, can always be made greater than the speed of the line being payed out from the main drum. The line speeds are equalized through operation of the slipping clutch 102′, in a manner similar to that described in conjunction with the preferred embodiment. Thus, increasing pressure on the slipping clutch increases the line tension, and, vice versa, decreasing pressure on the clutch decreases line tension. The sprag clutch 142 is constructed and arranged on the sleeve 130 so that its spur gear 72′ can rotate faster than the drive shaft. It is to be realized that if the jaw clutch were disengaged in the outhaul mode of operation, the drum would be driven more slowly through the spur gear 72′.

During inhaul, that is, inhauling line and wrapping it on the main drum, the jaw clutch 140 is disengaged. The diameters of spur gears 72′ and 90′ are chosen such that the line speed from the haulback drum can always be made less than the speed at which line is being taken up by the main drum. The sprag clutch 142 is arranged and constructed so that during inhaul it couples the spur gear 72′ and the sleeve 130 in driving relationship. The line speeds are equalized during inhaul by increasing air pressure on the slipping clutch to increase the line tension. If, in this mode of operation the jaw clutch were engaged, the drum would lock up as the spur gear 70′ would attempt to drive the spur gear 72′ thru gears 92′ and 90′ faster than the drive shaft. Thus, care must be taken with the alternate embodiment to insure that the jaw clutch is always disengaged during inhaul.

Figure 4:
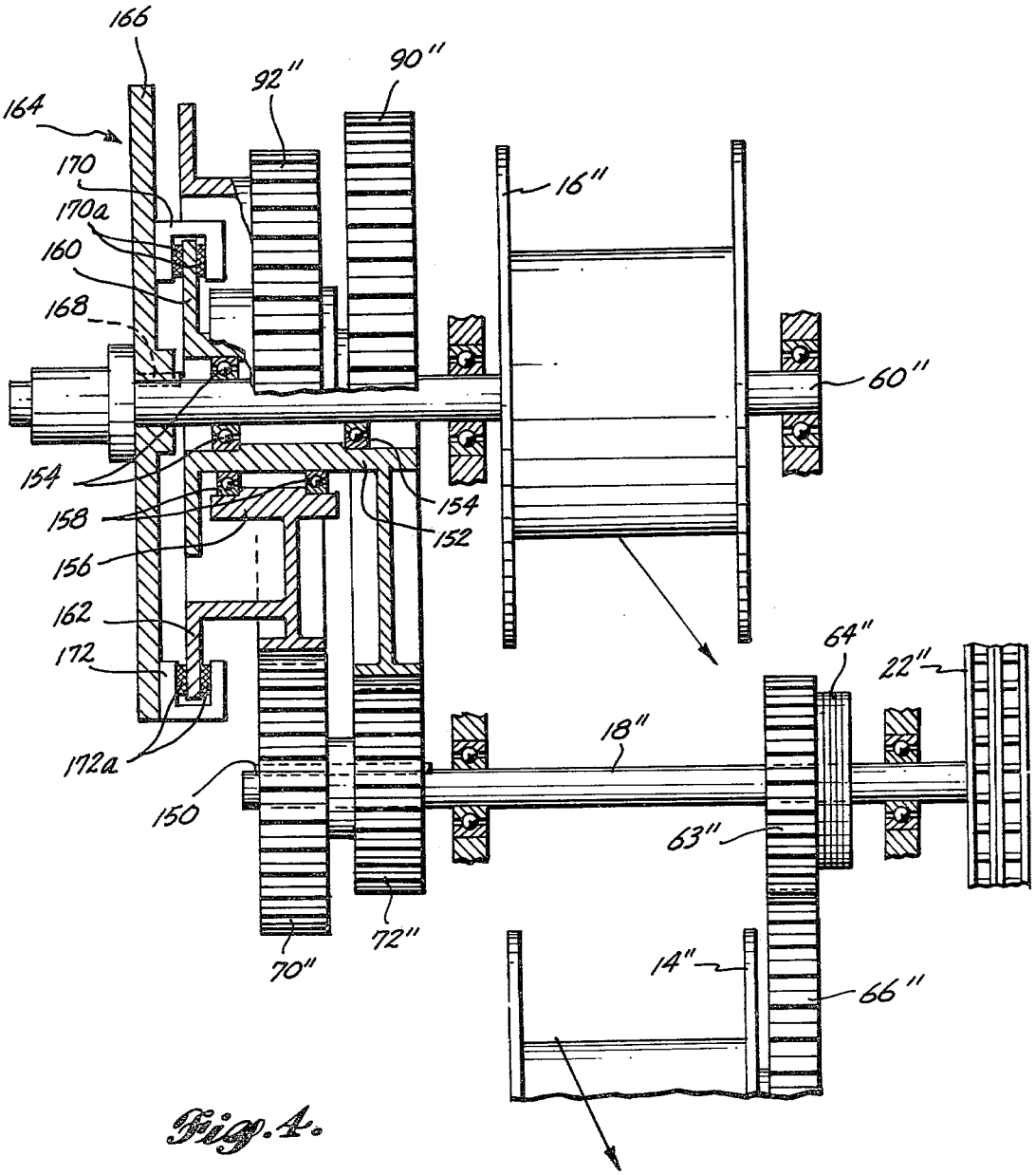
FIG. 4 is a partially schematic plan view, in partial cross section, illustrating a presently preferred embodiment of the present invention.

A presently preferred embodiment of the subject invention is schematically illustrated in FIG. 4. This embodiment, although providing an alternate means for achieving relative slippage between the haulback shaft 60″ and the drive shaft 18″,is otherwise similar in construction and arrangement to the embodiments described in conjunction with FIGS. 2 and 3. In the preferred embodiment, the driven gear 22″ is mounted in driving relationship on the drive shaft 18″. The spur gear 63″ is selectively couplable to the drive shaft 18′ by a conventional plate-type clutch 64″. Spur gear 63″ meshes with the main drum gear 66″, in turn affixed to the main shaft (not shown) to rotatably drive the main drum 14″.

The drive spur gears 70″ and 72″ in this preferred embodiment are affixed to the drive shaft 18″ by a key 150 engaging appropriate keyways in the drive shaft and the gears 70″ and 72″. The drive spur gears 70″ and 72″ mesh respectively with driven gears 92″ and 90″ mounted for rotation on and relative to the haulback shaft 60″. The larger driven gear 90″ is integrally affixed to a sleeve 152 mounted for rotation on haulback shaft 60'' by bearings 154. The smaller driven gear 92'' is integrally affixed to a second sleeve 156 mounted concentrically about the haulback shaft 60'' and the first sleeve 152. The second sleeve 156 is mounted for rotation on and relative to the first sleeve 152 by bearings 158. Each of the sleeves 152 and 156 respectively carries radially extending clutch discs 160 and 162. The first clutch disc 160 has a smaller outside diameter than the second clutch disc 162 and is radially located inside the second clutch disc 162.

A driven clutch mechanism, generally designated 164, includes a caliper mounting disc 166 oriented orthogonally to the haulback shaft 60'' and keyed to the haulback shaft 60'' by a suitable key 168. Thus, the caliper mounting disc 166 is arranged in driving relationship with the shaft 60'' to drive the haulback drum 16'', affixed to the drive shaft 60'' in driven relationship. Calipers 170 and 172 are affixed to the caliper mounting disc 166 at appropriate radial locations on the mounting disc relative to the haulback shaft 60'' and to the clutch discs 160 and 162 so that the clutch pads **170*a* and 172*a* can respectively engage the sides of the clutch discs 160 and 162 adjacent the peripheries thereof. Although the calipers 170 and 172 are schematically illustrated, one of ordinary skill in the art will readily realize that the calipers are selectively operable to engage, partially engage, or disengage from the clutch discs 160 and 162. When the caliper 170 engages the clutch disc 160, the larger driven gear 90'' is coupled in driving engagement with the caliper mounting disc 166 and thus the haulback shaft 60''. When the caliper 172 engages the clutch disc 162, the smaller driven gear 92'' is coupled in driving engagement with the caliper mounting disc 166 and again the haulback shaft 60''. When the calipers are disengaged, the respective driven gears 90'' and 92'' are free to rotate relative to the haulback shaft 60''. When either of the calipers is partially disengaged, the respective driven gear 90'' or 92'' is coupled in partial driving relationship to the caliper mounting disc 166. However, when partially engaged, the respective clutch disc is allowed to slip relative to its caliper, thereby allowing differential rotation between the driven gears 90'' and 92'' and the caliper mounting disc 166. The relative difference in rotational speed between the caliper mounting disc 166 and the respective gears 90'' and 92''** is dependent upon the pressure applied by the calipers through the pads and thus to the respective discs.

During outhaul, that is, when line is being wrapped onto the haulback drum 16'', the caliper 170 associated with the larger driven gear 90'' is disengaged so that the latter rotates freely relative to the haulback shaft 60''. The caliper 172 is fully or partially engaged with the clutch disc 162 so that the smaller of the driven gears 92'' is coupled in driving relationship through the haulback shaft 60''. The clutch 64'' engaging the drive shaft 18'' to the spur gear 63'' is of course engaged so that line is payed out from the main drum 14''. As in the previous embodiments, the diameters of the meshing gears 70'' and 92'' are chosen such that the speed of the haulback shaft 60'' and thus the line speed onto the haulback drum 16'' can always be made greater than the line speed of the line being payed out from the main drum 14''. The line speed onto the haulback drum 16'' is equalized with the line speed of line being payed out from the main drum 14'' by only partially engaging the caliper 172 with the clutch disc 162, thus allowing relative rotation between the driven gear 92'' and the haulback shaft 60''. By varying the clutch pressure, the line speeds can be equalized regardless of the amount of line wrapped on either of the main or haulback drums 14'' and 16'', respectively. That is, the line speed onto the haulback drum 16'' is increased by applying increasing pressure with the caliper 172 and is decreased by reducing the pressure applied by caliper 172.

During inhaul, the caliper 172 is disengaged and the caliper 170 is either fully or partially engaged, as necessary, to equalize the speed of the line being payed out from the haulback drum with the speed of the line being wrapped about the main drum 14''. Again, the diameters of the drive gear 72'' and the driven gear 90'' are chosen so that the haulback line speed can always be made less than the speed at which line is being taken up by the main drum. The haulback line speed during the inhaul mode is varied similarly to that during the outhaul mode, except that the varying pressure is applied by caliper 170 during inhaul.

The embodiment of the invention depicted in FIG. 4 and just described is preferred as it employs still fewer components than the first two embodiments described. The preferred embodiment, however, still retains the basic concept of employing selectively engagable gear sets that allow the haulback line speed and the main line speed to be equalized during inhaul and outhaul. As in the previous embodiments, the equalization of haulback and main line speeds in this embodiment is accomplished by allowing relative rotation between the driving and driven components of the power train between the drive shaft and the haulback shaft. In this embodiment, the heat energy produced is dissipated through the clutch elements themselves. Additionally, one of ordinary skill will readily recognize that the clutch elements of the preferred embodiment can be embodied in what is normally referred to as disc brake. Suitable clutch mechanisms for the preferred embodiment are commercially available from Goodyear Industrial Brake Division of Berea, Ky.

Thus the present invention, through the use of an energy-dissipating power transfer device and the unique arrangement of the secondary jaw, sprag or air operated clutches, and through the appropriate choice of gearing between the drive shaft and the energy-dissipating, power transfer device, enables an operator of a line hauling system to maintain tension in the main and haulback lines at all times. The present invention eliminates the use of the two or more large energy-dissipating, slipping brakes of the type normally employed in prior art mechanical line hauling systems as well as eliminates the need for expensive mechanical and hydraulic interlocking systems. The present invention, as can readily be seen by one of ordinary skill in the art, is inexpensive, has relatively low maintenance rate, and is simple to operate, as manipulation of the control system for only a single slipping clutch is required to control line tension. One of ordinary skill will also realize after reading the foregoing specification that many changes, substitutions of equivalents, and alterations can be made to the disclosed systems without departing from the broad concepts disclosed. It is therefore intended that the scope of Letters Patent granted hereon be limited only by the definition contained in the appended claims and equivalents thereof.

The embodiments of the invention in which an exclusive property or privilege is claimed are defined as follows:

1. In a system for inhauling and outhauling lines including a drive shaft, a prime mover operably coupled to rotatively drive said drive shaft, and a reversible transmission means operably interposed between said prime mover and said drive shaft for selectively reversing the rotational direction of said drive shaft, a haulback drum mounted in a haulback shaft and a line wrapped on said haulback drum, and a main drum mounted on a main shaft and a line wrapped on said main drum, the improvement comprising:

a first gear mounted on and arranged in driven relationship with said drive shaft and a second gear arranged in driven relationship with said first gear mounted on one of said main shaft and said haulback shaft, and clutch means operatively associated with said first and second gears for selectively coupling said drive shaft to said one shaft in driving relationship to rotate the corresponding one of the main drum and the haulback drum mounted on said one shaft to take in a pay out line at a first line speed, a third gear mounted on and arranged in driven relationship with said drive shaft and a fourth gear arranged in driven relationship with said third gear and mounted on the other of said main shaft and haulback shaft to rotate the corresponding one of the main drum and the haulback drum mounted on said other shaft to take in and pay out line at an effective line speed less than said first line speed, a fifth gear mounted on and arranged in driven relationship with said drive shaft and a sixth gear arranged in driven relationship with said fifth gear and mounted on the other of said main shaft and said haulback shaft, to rotate the corresponding one of said main drum and said haulback drum mounted on said other shaft to take in and pay out line at an effective line speed greater than said first line speed, said third and fifth gears forming a first gear set and said fourth and sixth gears forming a second gear set, one of said first and second gear sets being affixed to the shaft on which they are mounted, the other of said first and second gear sets being mounted for rotation relative to the shaft on which they are mounted, and an energy-absorbing clutch means affixed to the shaft on which said other of said first and second gear sets is mounted for selectively and alternately coupling one of the gears of said other set in driving relationship to the shaft on which it is mounted and for selectively allowing restrained, relative movement between said one of the gears of said other set and the shaft on which it is mounted so that the line speed to and from the haulback drum can be substantially equalized with the line speed respectively from and to the main drum.

2. In the system of claim 1 wherein said third and fifth gears are affixed to said drive shaft and wherein said fourth and sixth gears are mounted on said haulback shaft for rotation relative thereto.

* * * * *

UNITED STATES PATENT AND TRADEMARK OFFICE

CERTIFICATE OF CORRECTION

PATENT NO. : 4,295,636

DATED : October 20, 1981

INVENTOR(S) : Frederic E. Langford

It is certified that error appears in the above-identified patent and that said Letters Patent are hereby corrected as shown below:

Column 4, line 32, "ad" is changed to --and--
Column 6, line 4, "ad" is changed to --and--
line 12, "vary" is changed to --varying--
line 13, "haulvack" is changed to --haulback--
line 24, insert --,-- after "Seattle" (second occurrence)
Column 10, line 55, insert --a-- after "has"
Column 11, line 9, "in" is changed to --on--
line 23, "a" first occurrence, to read -- and --.
Column 12, line 21, insert --rotational-- after "relative"

Signed and Sealed this

*Eighth* Day of *June 1982*

[SEAL]

*Attest:*

GERALD J. MOSSINGHOFF

*Attesting Officer*

*Commissioner of Patents and Trademarks*